United States Patent [19]

Kübler et al.

[11] Patent Number: 4,903,599

[45] Date of Patent: Feb. 27, 1990

[54] PRINTED PRODUCTS AND A PROCESS FOR THEIR MANUFACTURE

[75] Inventors: Rolf Kübler, Stuttgart; Volker Schabacker, Ludwigsburg, both of Fed. Rep. of Germany

[73] Assignee: BASF Farben & Fasern Akg., Hamburg, Fed. Rep. of Germany

[21] Appl. No.: 233,940

[22] Filed: Aug. 17, 1988

Related U.S. Application Data

[63] Continuation of Ser. No. 878,530, Jun. 23, 1986, abandoned, which is a continuation of Ser. No. 637,766, Aug. 6, 1984, abandoned, which is a continuation-in-part of Ser. No. 413,143, Aug. 30, 1982, abandoned.

[30] Foreign Application Priority Data

Oct. 10, 1981 [DE] Fed. Rep. of Germany ..... 3140360
Jun. 23, 1982 [DE] Fed. Rep. of Germany ..... 3223353

[51] Int. Cl.[4] ..... B41F 7/20

[52] U.S. Cl. ..... 101/450.1; 101/491; 106/20

[58] Field of Search ..... 101/450.1, 491; 106/20

[56] References Cited

U.S. PATENT DOCUMENTS

| | | | |
|---|---|---|---|
| 1,669,416 | 5/1928 | Huebner | 101/456 |
| 1,678,091 | 7/1928 | Wilhelm | 106/20 |
| 2,063,071 | 12/1936 | Wittenbel | 428/915 |
| 2,384,857 | 9/1945 | Terry | 430/302 |
| 2,868,741 | 1/1959 | Chambers | 106/30 |
| 2,895,846 | 7/1959 | Schaefer | 428/429 |
| 2,974,058 | 3/1961 | Pihl | 101/426 |
| 2,989,412 | 6/1961 | Koehler | 106/30 |
| 3,079,270 | 2/1963 | Cortez | 106/20 |
| 3,368,483 | 2/1968 | Storms | 101/450.1 |
| 3,406,137 | 10/1968 | Terry | 106/30 |
| 3,511,178 | 5/1970 | Curtin | 101/467 |
| 3,513,000 | 5/1970 | Vramcken | 106/31 |
| 3,585,932 | 6/1971 | Granger | 101/350 |
| 3,608,483 | 9/1971 | Kaminstein | 101/452 |
| 3,677,178 | 7/1972 | Gipe | 101/450.1 |
| 3,772,016 | 11/1973 | Anderson | 101/458 |
| 3,776,758 | 12/1973 | Epple | 427/275 |
| 3,803,109 | 4/1974 | Nemoto | 106/20 |
| 3,855,147 | 12/1974 | Granquist | 106/20 |
| 3,877,372 | 4/1975 | Leeds | 101/465 |
| 3,910,187 | 10/1975 | Cords | 101/450.1 |
| 3,968,278 | 7/1976 | Wells | 427/258 |
| 4,004,931 | 1/1977 | Lu | 106/30 |
| 4,078,493 | 3/1978 | Miyamoto | 101/450.1 |
| 4,148,767 | 4/1979 | Spicer | 106/29 |
| 4,193,806 | 3/1980 | Finlayson | 106/20 |

FOREIGN PATENT DOCUMENTS

| | | | |
|---|---|---|---|
| 1187641 | 2/1965 | Fed. Rep. of Germany | 101/466 |

OTHER PUBLICATIONS

Apps Printing Ink Technology; pp. 342 and 343, Essential Properties of Lithographic Inks.

Woof, A Manual for Flexographic Inks, pp. 66–70, Water Based Inks.

Duffy, Printing Inks, Developments since 1975, pp. 1–3, Flexographic Lithographic and Intaglio Inks.

Weast, CRC Handbook of Chemistry and Physics pp. F-36 and F37 Viscosity.

*Primary Examiner*—Clifford D. Crowder
*Attorney, Agent, or Firm*—Kenyon & Kenyon

[57] ABSTRACT

Printed products obtained by the planographic printing process whereby printing inks are transferrred by means of a lithographic printing plate to a printing stock, and a corresponding planographic printing process for forming the products. Printing inks which predominantly contain water as a solvent and/or dispersing agent and having a dynamic viscosity of 10 to 250 Pa.s, and printing plates whose information-bearing, i.e., printing, areas are hydrophilic and whose non-printing areas are hydrophobic, are used.

25 Claims, 1 Drawing Sheet

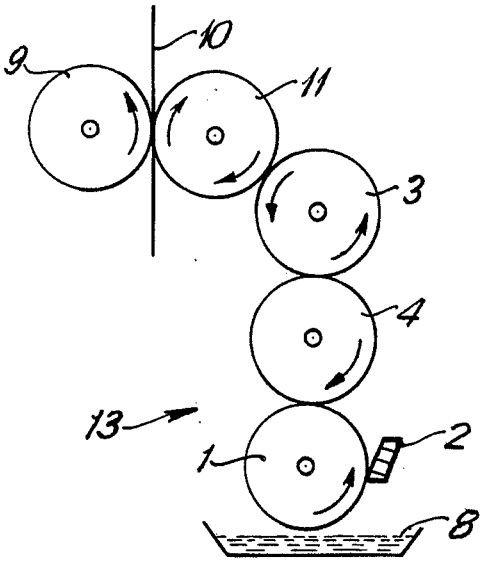
9
10
11
3
4
13
1
2
8

PRINTED PRODUCTS AND A PROCESS FOR THEIR MANUFACTURE

CROSS-REFERENCE TO RELATED APPLICATIONS

This application is a continuation of application Ser. No. 878,530, filed June 23, 1986, now abandoned, which was a continuation of application Ser. No. 637,766, filed Aug. 6, 1984, now abandoned, which was a continuation-in-part of application Ser. No. 413,143, filed Aug. 30, 1982, now abandoned.

Applicants claim priority under 35 USC 119 for applications P 31 40 360.3-45, filed Oct. 10, 1981, and P 32 23 353.1 filed June 23, 1982, both in the Patent Office of the Federal Republic of Germany.

BACKGROUND OF THE INVENTION

The invention relates generically to printed products obtained by the planographic printing process whereby printing inks are transferred by means of a lithographic printing plate to a printing stock, and to a process for their manufacture.

A known printing process is offset printing. Offset printing has in recent years gained considerable economic importance. In offset printing, the incompatibility of water and oil is used to divide a homogeneous oil-containing printing ink film on a printing plate into the corresponding information areas.

Offset printing plates have the properties of being hydrophilic in the non-information-bearing areas and oleophilic in the information-bearing areas. In the course of the printing process, the plate is completely wetted with a water film (dampening solution), and inking them takes place with the oil-containing printing ink. The hydrophilic areas wetted by water cannot be wetted by the hydrophobic oily ink. This produces a colored printing image on the printing plate which is transferred, via a roller mechanism, to the printing stock.

The essential advantages of offset printing are the simply, inexpensively, and very rapidly preparable print carrier, the possibility of producing printing plates directly with the aid of electronic data processing, and the possibility of four color wet-on-wet printing.

To obtain an absolutely uniform ink film over the entire width of the printing machine, the highly viscous printing inks used in offset printing need to be worked between rollers several times. Inking mechanisms of offset printing machines have up to 30 rollers between which the pasty printing inks are worked. Because of this long and thorough working, it is not possible to use, as is customary in gravure printing, low-boiling solvents but rather only high-boiling solvents since otherwise surface-drying of the printing ink on the ink rollers would already take place and, hence, disrupt the ink flow.

Solvents used in practice are high-boiling mineral oils and those vegetable oils which are hydrophobic and insoluble in water.

The use of high-boiling mineral oils as solvents in offset printing inks has considerable disadvantages. Either drying takes too long, since the mineral oils take a relatively long time to penetrate into the paper surface (strike-in) and are hampered by the water in the paper or, on increasing the drying temperature to an economically sensible level (150 to 160° C.), the paper dries out and cockles, so that the subsequent processing steps, such as cutting, collating and binding, are considerably impaired. Drying, for example in rotary offset, also consumes a considerable amount of energy.

During printing, printing ink and dampening solution are mixed in offset printing, i.e., an emulsion is formed. This process is in itself advantageous, since only the thereby resulting consistency of printing ink makes possible economical four color wet-on-wet printing. As is known to an expert, lifting of the preceding printed inks from the printing stock by subsequent printing units is prevented by emulsifying water into the printing ink. On the other hand, this process has the disadvantage that on starting up a printing machine a certain time is necessary for the ink/water equilibrium to become established. It is, therefore, quite possible that, on starting up a printing machine and on intermediate switching-off and re-starting, a total of 5 to 10% of a run to be printed is obtained as spoilage.

To avoid this disadvantage, attempts have been made to emulsify water into the printing ink already in its preparation. Although this idea has been extensively propagated; it has failed to become established since these printing inks are frequently unstable. Oil and water separate and a separate damping unit is indispensible on the printing machine since the amount of water is also neither controllable nor adaptable to the paper or the printing substrate. It may be mentioned in passing that conventional printing inks can absorb about 10 to 30% of water in the printing unit on the printing machine.

In addition to the conventional offset printing method described, so-called water-less offset printing is known. This process, by means of special printing plates in which the ink-bearing layers have been rendered hydrophobic and the non-ink-bearing layers have been made extremely repellent by means of a silicone coating, attempts to print with conventional offset printing inks without dampening solution. Despite intensive development work, this printing process has failed to become widely established in the market since a four color wet-on-wet print is associated with problems similar to those in conventional relief printing. This is true in particular on pick-sensitive papers.

The state of the art of aqueous printing inks used in gravure printing and flexographic printing may be ascertained by reference to U.S. Pat. Nos. 4,374,670; 4,309,179; 3,884,707; 4,108,812, and 4,238,234, the disclosures of which are incorporated herein by reference.

SUMMARY OF THE INVENTION

The object of the invention is to avoid the abovementioned disadvantages of the state of the art and to provide printed products as well as a process for their manufacture where the use of high-boiling organic solvents can be largely dispensed with while maintaining the advantages of offset printing. Moreover, the high losses incurred when a printing machine is started up and when printing is interrupted are intended to be avoided.

It has now been found, surprisingly, that aqueous printing inks can be used in planographic printing-instead of fatty printing inks, when the corresponding printing plates are prepared in such a way that the printing areas are hydrophilic and the non-printing areas are hydrophobic. Aqueous printing inks are in themselves known. However, they had hitherto been used exclusively in gravure and flexographic printing. Despite the disadvantages of fatty printing inks which have been known for a long time, it has hitherto not become known to use aqueous printing inks in a planographic printing process. It was surprising that good printing results can be obtained when using aqueous printing inks without exploiting the repellency of fat and water.

The invention therefore relates to printed products obtained by the planographic printing process whereby printing inks are transferred by means of a lithographic printing plate to a printing stock, wherein printing inks which predominantly contain water as a solvent and/or dispersing agent and printing plates whose information-bearing, i.e., printing, areas are hydrophilic and whose non-printing areas are hydrophobic have been used.

The invention also relates to a planographic printing process in which printing inks are transferred to a printing stock by means of a lithographic printing plate. The process according to the invention comprises using printing inks which predominantly contain water as a solvent and/or dispersing agent and printing plates whose information-bearing, i.e., printing, areas are hydrophilic and whose non-printing areas are hydrophobic.

BRIEF DESCRIPTION OF THE DRAWING

The FIGURE of the drawing shows a section through a planographic printing machine.

The planographic printing machine has an inking mechanism (13), a printing plate cylinder (3), a blanket cylinder (11), and an impression cylinder (9). The printing stock (10) passes between the blanket cylinder (11) and the impression cylinder (9). The inking mechanism (13) comprises an engraved roller (1) on which a doctor blade (2) is mounted and an ink transfer roller (4), which is located between the engraved roller (1) and the printing plate cylinder (3). The engraved roller (1) projects into the printing ink duct (8). As shown in the figure, all rollers and cylinders have the same diameter.

DESCRIPTION OF THE PREFERRED EMBODIMENTS

The printing inks to be used according to the invention contain colored pigments and/or soluble dyestuffs, binders which fix the pigments on the surface of the printink stock and other auxiliaries, such as waxes, defoamers, disinfectants and thickeners, which are known from other fields, for example aqueous printing inks for gravure or flexographic printing, or from the area of aqueous finishes and paints. The binder used can be not only dispersions but also binders soluble in water.

The printing inks predominantly contain water as a solvent and/or dispersing agent. In addition to water, they can contain a minor amount of organic solvents which are completely or partially miscible with water. Small amounts of petroleum fractions are possible only as auxiliaries and care must be taken that the printing ink retains its aqueous character.

Advantageously, printing inks can be used which correspond to the, aqueous printing inks of gravure or flexographic printing but are more viscous than the latter.

Suitable auxiliaries for improving slip are, as in the case of other printing ink, natural and synthetic waxes, polyethylene, and the like. Partial fluorination of the auxiliaries improves, in some cases, the abrasion resistance.

Thickeners used are inorganic or organic substances, in particular soluble or swellable materials. Materials known for this purpose are, inter alia, alginates, starch, cellulose and its derivatives, for example cellulose esters or cellulose ethers. Mineral substances which swell to some extent in polar solvents act in the same way.

All known coloring components, such as, for example, organic and inorganic colored pigments, preferably directly from water doughs, and dyestuffs which are soluble in water or in solvents, are suitable for coloring the inks. These coloring products are known from other areas of printing and paint technology.

Printing inks to be used according to the invention are prepared by known- methods. Thus, pigments, pigment formulations or pre-dispersed pigments can be incorporated into the aqueous binder solution or mixture by means of, for example, stirrers and dispersers.

To carry out the process according to the invention, printing plates are advantageously used whose non-printing areas are coated with silicone rubber and, whose information-bearing areas are metal areas or hydrophilic plastic surfaces. Suitable examples are printing plates as used in so-called waterless offset printing.

To improve printability, i.e., to improve the ink repellency of non-printing areas, for example on printing plates coated with silicone rubber, additions of additives containing silicone groups are of use. These additives can be dispersed silicone oils or water-soluble silicone derivatives.

The printing inks can be transferred from the inking mechanism of the printing machine to the printing stock directly or via an intermediate carrier. A blanket cylinder known from offset printing can serve as the intermediate carrier. In general, it can be advantageous to use an offset printing machine which is in itself known and whose damping unit has been removed or put out of action. If desired, the inking mechanism of the printing machine is reduced, i.e., any rollers not necessary for ink flow are removed. This measure counteracts the evaporation of water which, compared to high-boiling mineral oils, takes place at a more rapid rate. It is also possible to enclose the inking mechanism for this purpose.

In an advantageous embodiment of the process according to the invention, the printing inks are transferred via an engraved roller on which a doctor blade is mounted and via an ink transfer roller downstream of the engraved roller to a printing plate cylinder and from the latter via a blanket cylinder to the printing stock.

The engraved roller advantageously operates as a dipping roller, i.e., it projects into a printing ink duct.

Apart from using a single ink transfer roller, it is also possible to use two or more, ink transfer rollers working in parallel. However, it is essential that the situation is such that each of the ink transfer rollers cooperates directly with the engraved roller and with the printing plate cylinder and not that several rollers are mounted in series.

In an advantageous embodiment of the process according to the invention, the engraved roller acts as a dipping roller, i.e., it projects into the printing ink supply. The printing inks can, of course, also be applied in a different known manner, for example by brushing, to the doctor blade roller.

In the process according to the invention, the disadvantages of the mechanical sensitivity of an impression cylinder forming the ink film are avoided by using an engraved metal roller. This roller is also more resistant to bending and can be wiped with precision, by using cell walls produced by etching or engraving as supporting elements.

The uniform ink-receiving depressions over the entire width of the engraved roller ensure uniform inking regardless of different ink consumption in different areas of the pattern being printed. This also assists standardization in offset printing. Existing inking mechanisms cannot maintain the degree of inking at a constant value during the printing process.

Particular requirements in respect of thicker or thinner ink films, for example for coarser papers, can be satisfied by using engraved rollers etched deeper or shallower.

Still better ink supply can advantageously be obtained by temperature control of the engraved roller, since the ink viscosity is no longer changed by temperature influences. In the case of conventional long inking mechanisms, the inking mechanism warms up by internal friction and by many splitting processes of the inks whereby the inks become less viscous during the print run. This alters the ink transfer and the thickness of the ink film in the printing image. Spoilage can only be avoided by careful continuous control of inking by the printer.

To reduce tracing further or to completely eliminate it, the printing plate cylinder and the ink transfer roller advantageously have the same diameter. It is particularly advantageous when the engraved roller and the blanket cylinder also have the same diameter as the printing plate cylinder and the ink transfer roller.

The invention also relates to the use of predominantly aqueous printing inks in a planographic printing process and to printing inks for carrying out the process, which contain inorganic and/or organic pigments, binders and essentially water as a solvent and/or dispersing agent and have a dynamic viscosity of 10 to 250 Pa·s (pascal seconds), advantageously of 20 to 50 Pa·s, measured at 23° C. by means of a disk cone viscometer of the Ferranti-Shirley type.

The critical viscosity range is achieved by maintaining sufficient solid content in the ink composition and by the addition o thickeners.

The printing inks according to the invention advantageously contain silicone oil and/or water-soluble silicone derivatives.

The invention also relates to a planographic printing machine for carrying out the process and having an inking mechanism, a lithographic printing plate cylinder and a blanket cylinder, wherein the information-bearing, i.e., printing, areas are hydrophobic and the inking mechanism has an engraved roller on which a doctor blade is mounted, and an ink transfer roller located between the engraved roller and the printing plate cylinder.

Advantageously, the engraved roller projects as the dipping roller into a printing ink duct.

To reduce or avoid tracing, the printing plate cylinder and the ink transfer roller advantageously have the same diameter. It is particularly advantageous when the engraved roller and the blanket cylinder also have the same diameter as the printing plate cylinder and the ink transfer roller.

To obtain a good printing result, advantageously the non-printing areas of the printing plate cylinder are coated with silicone rubber and the information-bearing, i.e., printing, areas are metal surfaces or hydrophilic plastic surfaces.

The invention achieves the following advantages: a short inking mechanism containing only a few splitting points for the ink reduces the rate of evaporation of the volatile constituents considerably in comparison to conventional inking mechanisms with their many rollers Inks can, therefore, be used which contain water, which evaporates and strikes into the paper at a higher rate. All physical drying processes, i.e., striking into the paper, evaporation of the water in rotary offset heat setting or by IR radiators in sheet-set offset thus take place at a considerably higher rate than is the case with mineral oils of conventional inks, which oils strike in or evaporate slowly.

An essential advantage of the invention is the reduction of tracing by the short inking mechanism and the continual renewal of the ink film by the engraved roller.

The temperature in rotary offset heat setting drying ovens can be considerably reduced, depending on machine speed, printing stock and ink film thickness. This makes possible a considerably saving of energy. The papers dry to a lesser extent and thus remain stable to dimensional change, i.e., after drying they do not absorb water from the environment and no longer "grow" after processing or on storage. Under favorable conditions, these inks can even be dried in rotary offset using IR radiators. These limiting cases depend on paper, printing speed and ink film thickness. In contrast to non-polar conventional offset inks based on oil, the water-containing inks also respond to high frequency dryers.

The invention is illustrated below in more detail by means of illustrative examples.

EXAMPLE

Forty parts by weight of an aqueous emulsion of an alkali-soluble acrylate polymer having a solids content of 40% by weight, 20 parts by weight of propylene glycol, 4 parts by weight of triethanolamine, 4 parts by weight of a 35% strength methyl-silicone oil emulsion, 4 parts by weight of mineral oil having a boiling range of 190°–250° C. and 8 parts by weight of starch ether were mixed with one another. Twenty parts by weight of an aqueous pigment dough containing 45% by weight of copper phthalocyanine pigment were added to this mixture. The mass was dispersed on a three-roll mill to give a homogeneous printing ink.

An offset printing machine in accordance with the figure was used as the printing machine. A commercially available silicone-coated printing plate was used as the printing plate.

Printing was carried out on coated offset paper and prints of excellent quality were obtained.

What we claim:

1. A printed product obtained by a planographic printing process using printing inks transferred by means of a lithographic printing plate to a printing stock, without employing a dampening liquid, said printing inks having a dynamic viscosity of 10 to 250 Pa·s and predominantly containing a solvent consisting essentially of water, a water dispersing agent, or a mixture thereof, and said printing plate having information-bearing areas which are hydrophillic and non-printing areas which are hydrophobic.

2. In a planographic printing process comprising transferring printing inks by means of lithographic printing plates to a printing stock, without employing a dampening liquid, the improvement comprising said printing inks having a dynamic viscosity of 10 to 250 Pa·s and predominantly containing a solvent consisting essentially of water, a water dispersing agent, or mixtures thereof, and said printing plate having information-bearing areas which are hydrophilic and non-printing areas which are hydrophobic.

3. The process of claim 2 wherein said printing ink further comprises a gravure printing ink containing water as a solvent, and having a dynamic viscosity ranging from 10 to 250 Pascal seconds.

4. The process of claim 2, wherein said printing ink further comprises a flexographic printing ink having water as a solvent and having a dynamic viscosity ranging from 10 to 250 Pascal seconds.

5. The process of claim 2, wherein said printing plates have non-printing areas coated with silicone rubber.

6. The process of claim 2, wherein said printing plates have information-bearing areas with metal surfaces.

7. The process of claim 2, wherein said printing plates have information-bearing areas with hydrophilic plastic surfaces.

8. The process of claim 2, wherein said printing inks contain an addition of silicone oil.

9. The process of claim 2, wherein said printing inks contain an addition of water-soluble silicone derivatives.

10. The process of claim 2, comprising an intermediate carrier for transferring said printing inks from an inking mechanism of a printing machine to said printing stock.

11. The process of claim 10, wherein said printing machine is an offset printing machine without a damping unit.

12. The process of claim 10, wherein said printing inks are transferred via an engraved roller (1) on which a doctor blade (2) is mounted and via an ink transfer roller (4) downstream of said engraved roller to a printing plate cylinder (3) and from the latter via a blanket cylinder (11) to said printing stock (10).

13. The process of claim 12, wherein said engraved roller (1) projects as a dipping roller into a printing ink duct (8).

14. The process of claim 13, wherein said printing plate cylinder (3) and said ink transfer roller (4) have the same diameter.

15. The process of claim 14, wherein said ink roller (1) and said blanket cylinder (11) have the same diameter as said printing plate cylinder (3) and said ink transfer roller (4).

16. A method for planographic printing without employing a dampening liquid comprising: transferring printing inks to a printing stock by means of lithographic printing plates, wherein the non-printing areas of said plates are coated with silicone rubber and the information bearing area of said plates is comprised of a hydrophilic material and wherein the printing ink employed in said process has a dynamic viscosity of 10 to 250 Pa·s at 23° C. and wherein said ink is comprised of an acrylic binder and pigments and wherein said ink includes a solvent predominantly comprised of water.

17. The process according to claim 16 wherein said printing ink further comprises silicone oil.

18. The method according to claim 17 wherein the information bearing surfaces of said plate are comprised of a hydrophilic plastic.

19. The process according to claim 16 wherein said ink further comprises a water-soluble silicone derivative.

20. The method according to claim 16 wherein said information bearing areas of said printing plates are comprised of a hydrophilic plastic or metal surface.

21. The method according to claim 16 wherein said printing ink is comprised of a homogeneous dispersion of a pigment and an aqueous emulsion of alkali soluble acrylate polymer binder.

22. The method according to claim 21 wherein said emulsion of said alkali soluble acrylate polymer has a solids content of 40% by weight of said emulsion.

23. The method according to claim 22 wherein said printing ink is comprised of 40 parts by weight of said emulsion, 4 parts by weight of a methyl silicone oil emulsion, and 4 parts by weight of a mineral oil which boils in the range of 190–250° C.

24. The method according to claim 23 wherein said ink further comprises a pigment comprised of an aqueous pigment dough containing 45% by weight of pigment, and wherein said pigment comprises 20% by weight of said printing ink.

25. The method according to claim 16 wherein said printing ink employed in said process comprises:

40 parts by weight of an aqueous emulsion of an alkali soluble acrylate polymer having a solids content of 40% by weight; 20 parts by weight of propylene glycol, 4 parts by weight of triethanolamine, 4 parts by weight of methyl-silicone oil emulsion, 4 parts by weight of mineral oil and 20 parts by weight of an aqueous pigment dough.

* * * * *